United States Patent [19]

Nagata et al.

[11] 4,376,879

[45] Mar. 15, 1983

[54] BUTTON-LESS PUSH SWITCH BOARDS

[75] Inventors: Masumi Nagata; Fumiyoshi Kushima, both of Tokyo; Takeo Matsushima; Yasuhiro Fujioka, both of Toyota; Yasuhiro Iwata, Aichi; Teiichi Nabeta, Okazaki, all of Japan

[73] Assignee: Japan Aviation Electronics Industry Limited, Tokyo, Japan

[21] Appl. No.: 315,044

[22] Filed: Oct. 26, 1981

[30] Foreign Application Priority Data

Oct. 28, 1980 [JP] Japan ..... 55-152993[U]

[51] Int. Cl.[3] ..... H01H 9/16

[52] U.S. Cl. ..... 200/314; 200/159 B; 200/340

[58] Field of Search ..... 200/159 B, 310, 314, 200/317, 243, 340, 5 A

[56] References Cited

U.S. PATENT DOCUMENTS

| | | | |
|---|---|---|---|
| 2,562,185 | 7/1951 | Gross | 200/159 B |
| 3,591,749 | 7/1971 | Comstock | 200/159 B |
| 3,717,737 | 2/1973 | Shimojo | 200/159 B |
| 3,811,025 | 5/1974 | Bach | 200/159 B |
| 4,066,851 | 1/1978 | White et al. | 200/340 |
| 4,262,182 | 4/1981 | Basler et al. | 200/159 B |

FOREIGN PATENT DOCUMENTS

| | | | |
|---|---|---|---|
| 2280964 | 2/1976 | France | 200/159 B |

*Primary Examiner*—John W. Shepperd

*Attorney, Agent, or Firm*—Posnack, Roberts, Cohen & Spiecens

[57] ABSTRACT

A button-less push switch board including a plurality of push switches which comprises an insulator plate having a plurality of penetrating holes, a transparent flexible cover sheet overlying the main surface of the insulator sheet and having identification marks printed thereon to indicate the positions and functions of the switches, and a printed circuit plate on the reverse surface of the insulator plate and having fixed contacts formed thereon. A transparent block is disposed in each hole of the insulator plate and is urged towards the cover plate by elastic members supported thereon. Each elastic member is of cup-like shape and has a movable contact corresponding to a pair of fixed contacts on the printed circuit plate. A lamp or a light emitting diode is disposed in each hole of the insulator plate and is mounted on the printed circuit. Each fixed contact and each lamp or light emitting diode are connected to an external control circuit.

18 Claims, 4 Drawing Figures

BUTTON-LESS PUSH SWITCH BOARDS

BACKGROUND OF THE INVENTION

This invention relates to switch devices and, in particular, to button-less push switch devices and switch boards including the button-less push switches.

As one type of switch, there are known push switches of a non-lock type wherein the fixed and movable contacts are engaged with one another at a time when the push button is pushed but are kept disengaged during a time when the button is not pushed. The push switches of the non-lock type have been used for a power switch and other control switches together with electronic control circuits.

In place of push switches of the non-lock type, electrostatic switches have been used. Since the switch of this type is operated only by touching the switch without pushing any button, push button and contact must not be required so that operation and mechanical structure are simple. However, since the switch provides a turn-on or turn-off signal at a time when the electrostatic capacity surrounding the electrostatic switch, the electrostatic switch is apt to operate erroneously by, such as, non-intended touch of the switch. In particular, non-intended switch or switches are readily touched erroneously in a control switch board or panel including a plurality of switches. For example, in a control switch panel used in an automobile, when any non-intended switch is operated by an erroneous touch of it, an accident may be caused.

Push switches do not operate in response only to touch of the switches so that erroneous operation of the switch is reduced. However, since push buttons project from the control panel, they are unattractive and not easily selected.

SUMMARY OF THE INVENTION

Accordingly, it is an object of this invention to provide a push switch having no push button.

It is another object of this invention to provide a button-less push switch having a pair of fixed and movable electric contacts and illuminating means for indicating that the switch is once operated.

It is still another object of this invention to provide a button-less push switch board including a plurality of switches which may be usable for a control switch panel in automobiles.

It is yet another object of this invention to provide a button-less push switch board wherein selection and operation of the switches is easily made.

It is a further object of this invention is to realize objects as described above with a simple construction and a low cost.

According to this invention, a button-less push switch board having a plurality of push switches is obtained which comprises insulator plate means having a plurality of holes penetrating therethrough at predetermined locations on the main surface thereof where the switches should be disposed. Cover plate means of a light transparent flexible sheet material are mounted on the insulator plate means to cover the main surface thereof. The cover plate means have identification marks of respective switches at locations corresponding to the holes of the insulator plate means. Printed circuit plate means are affixed to the insulator plate means to cover the reverse surface thereof and have at least one pair of adjacent fixed contact electrodes which is formed thereon at each location corresponding to each hole of the insulator plate means and terminals connected through leads to the contact electrodes. Light transparent body means are fitted slidably in the holes of the insulator plate means. Respective transparent body means are elastically supported so that the top end surfaces thereof come into contact with the cover plate means and are permitted to be pushed down towards the circuit plate means in response to pushing of the area of the cover plate corresponding to the body means. At least one movable contact means is supported on the bottom surface of each transparent body means to short-circuit the at least one pair of contact electrodes when the transparent body means are pushed down. A plurality of light emitting means are mounted on the circuit plate means and are disposed in respective holes of the insulator plate means. Each light emitting means is connected to terminals formed on the printed circuit plate means so that each light emitting means may be illuminated in response to short-circuiting of the pair of fixed contact electrodes by the movable contact electrodes by pushing of the cover plate means.

According to a feature of this invention, the button-less switch device is obtained which comprises an insulator plate having a single hole penetrating therethrough. A printed circuit plate and a cover plate are mounted on the insulator plate similar to the switch board as described above.

The insulator plate is made of polyphenylenesulfite or polybutylene terephthalate.

The cover plate is made of polyester film.

The identification mark is printed in colored transparent ink or non-light transparent ink on the surface of the cover plate, or the surface of the cover plate is coated with non-light transparent ink layer printed thereon with the identification mark blank.

The light transparent body means are made of acrylic resin or polycarbonate resin. The light transparent body is provided with a hollow portion formed in the bottom surface, in which hollow portion the light emitting means are inserted. The depth of the hollow portion is determined so that a line extending from an edge of the bottom surface of the hollow portion to an edge of the top end surface of the light transparent body makes an angle of 45° or more with the top end surface of the light transparent body.

The light transparent body is supported by two cup-like members of elastic members of silicone rubber which are affixed to the bottom surface of the body with the open end of each cup-like members being in contact with the surface of the printed circuit plate. The movable contact electrodes are affixed to the inner bottom surfaces of respective cup-like members. Two pairs of fixed contact electrodes are disposed at both sides of the light emitting means, and the two cup-like members are disposed in correspondence with the pair of fixed contact electrodes.

Further objects, features and other aspects of this invention will be understood from the following detailed description of preferred embodiments of this invention with reference to the accompanying drawings.

DETAILED DESCRIPTION OF PREFERRED EMBODIMENTS

Figure 1:
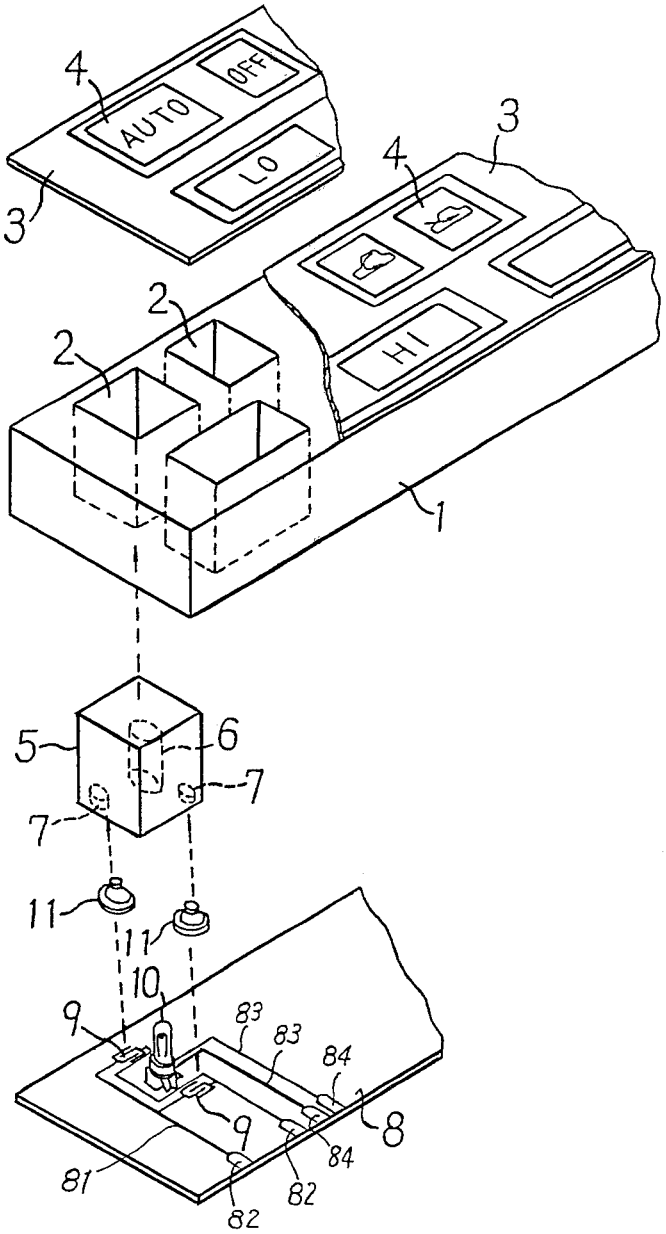
FIG. 1 is a perspective view of an exploded switch board according to this invention.
Figure 2:
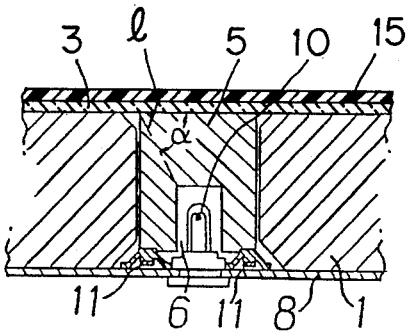
FIG. 2 is a sectional view of a switch portion of the switch board of FIG. 1.

Referring to FIGS. 1 and 2, a control switch panel for an automobile of an embodiment according to this invention includes a non-light transparent electric insulator plate 1 of, such as polyphenylenesulfite (P.P.S.) or polybutylene terephthalate (P.B.T.). Insulator plate 1 is formed with a plurality of holes 2 penetrating therethrough at locations where switches are to be disposed. Insulator plate 1 may have flange means (not shown) at its peripheral end portion for affixing the switch board to an object to which the switch board is to be mounted.

A cover plate 3 is mounted on, and adhered to insulator plate 1 to cover the main surface of insulator plate 1. Cover plate 3 is made of a light transparent flexible sheet material, such as a polyester film or other plastic film. Marks 4 such as characters or pictures for identifying the functions assigned to respective switches are illustrated by, for example, printing by colored transparent ink or non-transparent ink on cover plate 3 at locations corresponding to holes 2 of insulator plate 1. Cover plate 3 may be coated with a non-light transparent ink layer with the marks being blank. A light transparent thin plastic film 15 may be laminated on cover plate 3 to protect the printed identification marks 4.

A plurality of blocks 5 of light transparent material such as acrylic resin or polycarbonate resin are slidably fitted in respective holes 2 of insulator plate 1. Each block 5 is formed with a hollow portion 6 and two recesses 7 in the bottom surface.

A printed circuit plate 8 is mounted onto insulator plate 1 to cover its reserve surface and is affixed thereto by, for example, screws (not shown). Printed circuit plate 8 has two pairs of fixed adjacent contact electrodes 9 at each location corresponding to each hole 2 of insulator plate 1. Each two contact electrodes of the two pairs are connected to terminal 82 through a lead 81 formed on printed circuit board 8 and may be connected to an external control circuit (not shown) through the terminal.

A lamp or a light emitting diode 10 is also mounted on printed circuit plate 8 at each location corresponding to each hole 2 of insulator plate 1. Each lamp 10 is disposed in hollow portion 6 of each block 5. Each lamp 10 is also connected through lead conductors 83 to terminals 84 to be connected to an external source (not shown).

Figure 3:
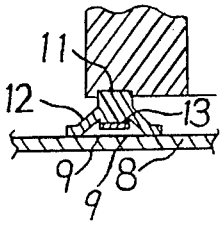
FIG. 3 is an enlarged sectional view of a main portion in FIG. 3.

A pair of movable contact assemblies 11 are supported by each block 5 by fitting their top projections into recesses 7. Each movable contact assembly 11 is composed of a cup-like elastic member 12 of silicone rubber or the like and a contact electrode 13 mounted on an inner bottom surface of cup member 12. As best shown in FIG. 3, the edge portion of elastic cup member 12 engages with the surface of printed circuit plate 8 to maintain contact electrode 13 spaced from the corresponding pair of fixed contact electrodes 9, due to elasticity of elastic cup member 12. The elasticity of cup-like member 12 also urges block 5 upwardly so that the top end of block 5 comes into contact with cover plate 3.

In operation, when cover plate 3 is pushed at a location corresponding to any one of identification marks 4, the corresponding one of blocks 5 is pushed down overcoming the elasticity of cup-like members 12 so that movable contacts 13 come into contact with the corresponding pairs of fixed contact electrodes 9 to short-circuit the contact electrodes of each pair so that the switch is turned on. After the pressing force applied to cover plate 3 is removed, the block 5 is raised by the elasticity of cup-like member 12 and movable contacts 13 are spaced from fixed contact electrodes 9.

Figure 4:
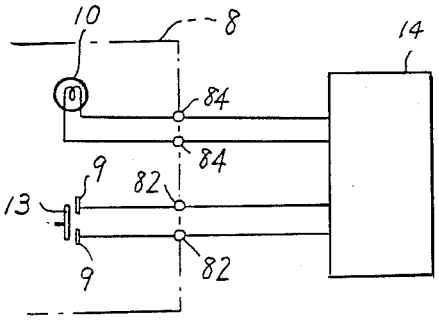
FIG. 4 is a circuit diagram illustrating an example of use of the switch.

In an example of use of the switch, terminals 82 and 84 are connected to an external control circuit 14 for a certain device, as shown in FIG. 4. Once fixed contact electrodes 9 are short-circuited by movable contact 13 or the switch is turned on, control circuit 14 receives the on-signal to start the device under control of the control switch panel and feeds the electric power to lamp 10 through terminals 84. Accordingly, lamp 10 emits light to illuminate the identification mark on cover plate 3. Thus, the operated switch or now operating device is indicated.

In order to illuminate each identification mark uniformly, the depth of hollow portion 6 is selected so that a line l extending from an edge of the bottom surface of the hollow portion to an edge of the top end surface of the light transparent body 5 makes angle $\alpha$ of 45° or more with the top end surface of the light transparent body 5.

Then, when cover plate 3 is again pushed at the same identification mark and when the switch thereby turns on, control circuit 14 stops the controlled device and stops the feed of electric power to lamp 10. Thus, as the switch is pushed repeatedly, start and stop of the controlled device is repeated.

In another use, a pair of two switches may be used for controlling the start and stop of a device. That is, one is an on-signal switch and the other is an off-signal switch. In this case, the control circuit operates to start the controlled device upon receiving a signal from the on-signal switch and to stop the operation of the controlled switch upon receiving a signal from the off-signal switch.

Each lamp 10 may be controlled by the control circuit to always illuminate with a low brightness but to illuminate with an increased brightness at a time when the switch is operated.

In the embodiment described above and illustrated in the drawings, the shape of each hole of the insulator plate and of each light transparent body is shown to be rectangular, but it may be of other shapes. Moreover, the insulator plate may be made of light transparent materials. However, in that case, the inner surface of each hole or the outer surface of each light transparent body must be coated with a non-light transparent film. Furthermore, the movable contact and the elastic member may be secured separately to the light transparent body.

One, or more than two pairs of fixed contact electrodes and movable contact electrodes may be used.

It will be readily understood by those skilled in the art that a button-less switch device can be similarly made by use of an insulator plate having a single hole penetrating therethrough.

What is claimed is:

1. A button-less push switch board having a plurality of push switches which comprises:

insulator plate means having a plurality of holes penetrating therethrough at predetermined locations on the main surface thereof where said switches are to be disposed;

cover plate means of a light transparent flexible sheet material mounted on said insulator plate means to cover said main surface, said cover plate means having identification marks of respective switches at locations corresponding to said holes of of said insulator plate means;

printed circuit plate means affixed to said insulator plate means to cover the reverse surface thereof and having at least one pair of adjacent fixed contact electrodes thereon at each location corresponding to each hole of said insulator plate means, and terminals connected through leads to said contact electrodes;

light transparent body means fitted slidably in said holes of said insulator plate means;

means for elastically supporting respective transparent body means so that the top end surface thereof comes into contact with said cover plate means and permitting respective transparent body means to be pushed down towards said circuit plate means in response to pushing of the area of said cover plate means corresponding to the body means;

at least one movable contact means supported on the bottom surface of each transparent body means for short-circuiting said at least one pair of contact electrodes when said transparent body means is pushed down; and a plurality of light emitting means mounted on said printed circuit plate means and disposed in respective holes of said insulator plate means, each light emitting means being connected to terminals formed on said printed circuit plate means which are to be connected to an external drive circuit, whereby each light emitting means is illuminated in response to shortcircuiting of each pair of fixed contact electrodes by the corresponding movable contact electrodes by pushing of said cover plate means, said printed circuit means having two pairs of said fixed contact electrodes at each location corresponding to each hole of said insulator plate, and two pairs of fixed contact electrodes being disposed at both sides of said light emitting means disposed in the hole, said movable contact means comprising two movable contact electrodes supported by said light transparent body means disposed in the hole, each of said light transparent body means including two of said elastically supporting means affixed to the bottom surface thereof, each of said elastically supporting means comprising a cup-like member of elastic material having a bottom portion affixed to the bottom surface of said light transparent body means and an open edge portion in contact with said printed circuit plate means, each of said movable contact electrodes being mounted on the inner bottom surface of each cup-like member.

2. The button-less push switch board as claimed in claim 1, wherein each hole of said insulator plate means is a rectangular hole, and each light transparent body means is a rectangular body.

3. The button-less push switch board as claimed in claim 1, wherein each identification mark is printed in colored transparent ink or non-light transparent ink on the surface of said cover plate means.

4. The button-less push switch board as claimed in claim 3, which further comprises a light transparent plastic film laminated onto said cover plate means to cover and protect the printed identification marks.

5. The button-less push switch board as claimed in claim 1, wherein each of said light transparent body means is provided with a hollow portion formed in its bottom surface, in which hollow portion the light emitting means is inserted.

6. The button-less push switch board as claimed in claim 5, wherein the depth of said hollow portion is determined so that a line extending from an edge of the bottom surface of said hollow portion to an edge of the top end surface of said light transparent body makes an angle of 45° or more with the top end surface of said light transparent body.

7. A button-less push switch device comprising:

insulator plate means having a hole penetrating therethrough;

cover plate means of a light transparent flexible sheet material mounted on said insulator plate means to cover the main surface thereof, said cover plate means having identification mark means of a switch at a location corresponding to said hole of said insulator plate means;

printed circuit plate means affixed to said insulator plate means to cover the reverse surface thereof and having at least one pair of adjacent fixed contact electrodes formed thereon at a location corresponding to the hole of said insulator plate means, and terminals connected through leads to said contact electrodes;

light transparent body means fitted slidably in said hole of said insulator plate means;

means for elastically supporting respective transparent body means so that the top end surface thereof comes into contact with said cover plate means and permitting said transparent body means to be pushed down towards said circuit plate means in response to pushing of the area of said cover plate means corresponding to said light transparent body means;

at least one movable contact means supported on the bottom surface of said light transparent body means for shortcircuiting said at least one pair of contact electrodes when said transparent body means is pushed down; and a light emitting means mounted on said printed circuit plate means and disposed in said hole of said insulator plate means, said light emitting means being connected to terminals formed on said printed circuit plate means which are to be connected to an external drive circuit, whereby said light emitting means is illuminated in response to short-circuiting of said pair of fixed contact electrodes by the corresponding movable contact electrodes by pushing of said cover plate means, said printed circuit means having two pairs of said fixed contact electrodes at said hole, said two pairs of fixed contact electrodes being disposed at both sides of said light emitting means disposed in the hole, said movable contact means comprising two movable contact electrodes supported by said light transparent body means disposed in the hole, said light transparent body means including two of said eleastically supporting means affixed to the bottom surface thereof, each of said elastically supporting means comprising a cup-like member of elastic material having a bottom portion affixed to the bottom surface of said light transparent body means and an open edge portion in contact with said printed circuit plate means, each of said movable contact electrodes being mounted on the inner bottom surface of each cup-like member.

8. The button-less push switch board as claimed in claim 7, wherein said hole of said insulator plate is rectangular, and said light transparent body is rectangular.

9. The button-less push switch board as claimed in claim 7, wherein said identification mark is printed in colored transparent ink or non-light transparent ink on the surface of said cover plate means.

10. The button-less push switch board as claimed in claim 9, which further comprises a light transparent plastic film laminated onto said cover plate means to cover and protect the printed identification marks.

11. The button-less push switch board as claimed in claim 7, wherein said light transparent body means is provided with a hollow portion formed in its bottom surface, in which hollow portion the light emitting means is inserted.

12. The button-less push switch board as claimed in claim 11, wherein the depth of said hollow portion is determined so that a line extending from an edge of the top end surface of said light transparent body makes an angle of 45° or more with the top end surface of said light transparent body.

13. A button-less push switch board as claimed in claim 1 or 7, wherein said insulator plate means is made of non-light transparent material.

14. The button-less push switch board as claimed in claim 13, wherein said insulator plate means is made of polyphenylenesulfite or polybutylene terephthalate.

15. The button-less push switch board as claimed in claim 1 or 7, wherein said cover plate means is made of polyester film.

16. The button-less push switch board as claimed in claim 1 or 7, wherein said light transparent body means is made of acrylic resin or polycarbonate resin.

17. The button-less push switch board as claimed in claim 1 or 7, wherein said light transparent body means is made of acrylic resin or polycarbonate resin.

18. The button-less push button switch board as claimed in claim 1 or 7 wherein each cup like member is made of silicone rubber.

* * * * *

UNITED STATES PATENT AND TRADEMARK OFFICE

CERTIFICATE OF CORRECTION

PATENT NO. : 4,376,879

DATED : March 15, 1983

INVENTOR(S) : NAGATA et al

It is certified that error appears in the above–identified patent and that said Letters Patent are hereby corrected as shown below:

Column 3, line 37; change "reserve" to --reverse--

Column 5, line 7; delete "of"

Column 6, line 63; change "eleastically" to --elastically--

Claim 18, line 1; delete "button" (second occurrence)

Signed and Sealed this

*Twenty-seventh* Day of *December 1983*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,376,879

DATED : March 15, 1983

INVENTOR(S) : NAGATA et al.

It is certified that error appears in the above—identified patent and that said Letters Patent is hereby corrected as shown below:

On the title page Item /73/ Assignee: should read:

TOYOTA JIDOSHA KOGYO KABUSHIKI KAISHA; and

NIPPONDENSO CO., LTD.

Signed and Sealed this

*Thirty-first* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,376,879

DATED : March 15, 1983

INVENTOR(S) : Masumi Nagata et al.

It is certified that error appears in the above-identified patent and that said Letters Patent is hereby corrected as shown below:

On the title page Item (73) Assignee: should read

JAPAN AVIATION ELECTRONICS INDUSTRY, LIMITED -TOKYO, JAPAN

TOYOTA JIDOSHI KOGYO KABUSHIKI KAISHA -AICHI, JAPAN

NIPPONDENSO CO., LTD., - AICHI, JAPAN

Signed and Sealed this

Tenth Day of March, 1992

*Attest:*

*Attesting Officer*

HARRY F. MANBECK, JR.

*Commissioner of Patents and Trademarks*